US005234129A

United States Patent [19]

Lau

[11] Patent Number: 5,234,129

[45] Date of Patent: Aug. 10, 1993

[54] TOY WATER GUN

[75] Inventor: Chi-Hung Lau, Kowloon, Hong Kong

[73] Assignee: Foundton Co. Ltd., Hong Kong

[21] Appl. No.: 895,702

[22] Filed: Jun. 9, 1992

[51] Int. Cl.[5] ..... A63H 3/18

[52] U.S. Cl. ..... 222/79; 222/130; 222/192; 446/18

[58] Field of Search ..... 222/79, 130, 192; 446/15, 16, 18, 21

[56] References Cited

U.S. PATENT DOCUMENTS

| | | | |
|---|---|---|---|
| 2,560,582 | 7/1951 | Limber | 446/18 |
| 2,700,845 | 2/1955 | Arliss | 446/18 |
| 3,389,492 | 6/1968 | Sullivan | 446/21 |
| 4,334,383 | 6/1982 | Melotti | 222/79 |

*Primary Examiner*—H. Grant Skaggs

*Attorney, Agent, or Firm*—Burns, Doane, Swecker & Mathis

[57] ABSTRACT

A toy water gun includes a manually operable mechanism for generating a jet of water and a manually operable mechanism for generating bubbles. Both mechanisms may be operated simultaneously to give the appearance of a stream of bullets and smoke rising.

2 Claims, 2 Drawing Sheets

TOY WATER GUN

FIELD OF THE INVENTION

The present invention relates to toy water guns, for example water pistols, for use by children.

PRIOR ART

Many different constructions of water gun are known. The different constructions differ in outward appearance, in the internal mechanisms for producing the jet of water, and in the arrangement of the reservoir for storing the water. Outwardly these guns are operated in a fairly similar manner, and from the point of view of the child the only difference between the different constructions is the outward appearance, and also the capacity to store water, and the rate of discharge of water.

OBJECT AND THE SUMMARY OF THE INVENTION

The object of the present invention is to provide a toy water gun with novel and attractive functional features which appeal to children.

The invention provides a toy water gun including a reservoir for containing water, a nozzle through which a jet of water may be fired, and a water pumping mechanism for pumping water from the water reservoir out through the nozzle, the toy water gun further including an additional reservoir for bubble forming liquid, a ring within which a film of bubble forming liquid may be formed, a ring mounting, the ring mounting being operable to move the ring from a first charging position within the additional reservoir so as to take up a charge of bubble forming liquid and a second firing position outside the reservoir in which bubbles may be blown from the ring, a bellows which may be manually compressed to direct a stream of air to the ring in the firing position thereof, and a linkage operatively connecting the bellows to the ring mounting so that as the bellows is compressed the ring is moved from the charging position to the firing position.

By "ring" in this context is meant an open frame member capable of supporting a film of bubble forming liquid. The open frame member may be of any desired shape and in particular need not be circular.

The advantage of this arrangement is that the toy water gun can be used to either discharge a jet of water or generate a stream of bubbles or both. When both functions are used simultaneously the combination of the jet of water and the stream of bubbles resembles a stream of bullets together with smoke rising.

Preferrably the bellows is configured to have the appearance of the pump action of a gun and the ring mounting and the ring are arranged so that in the firing position they have the appearance of a gunsight.

This particular configuration allows the toy water gun to serve both functions while at the same time presenting a realistic appearance.

DETAILED DESCRIPTION OF THE PREFERRED EMBODIMENT

Figure 1:
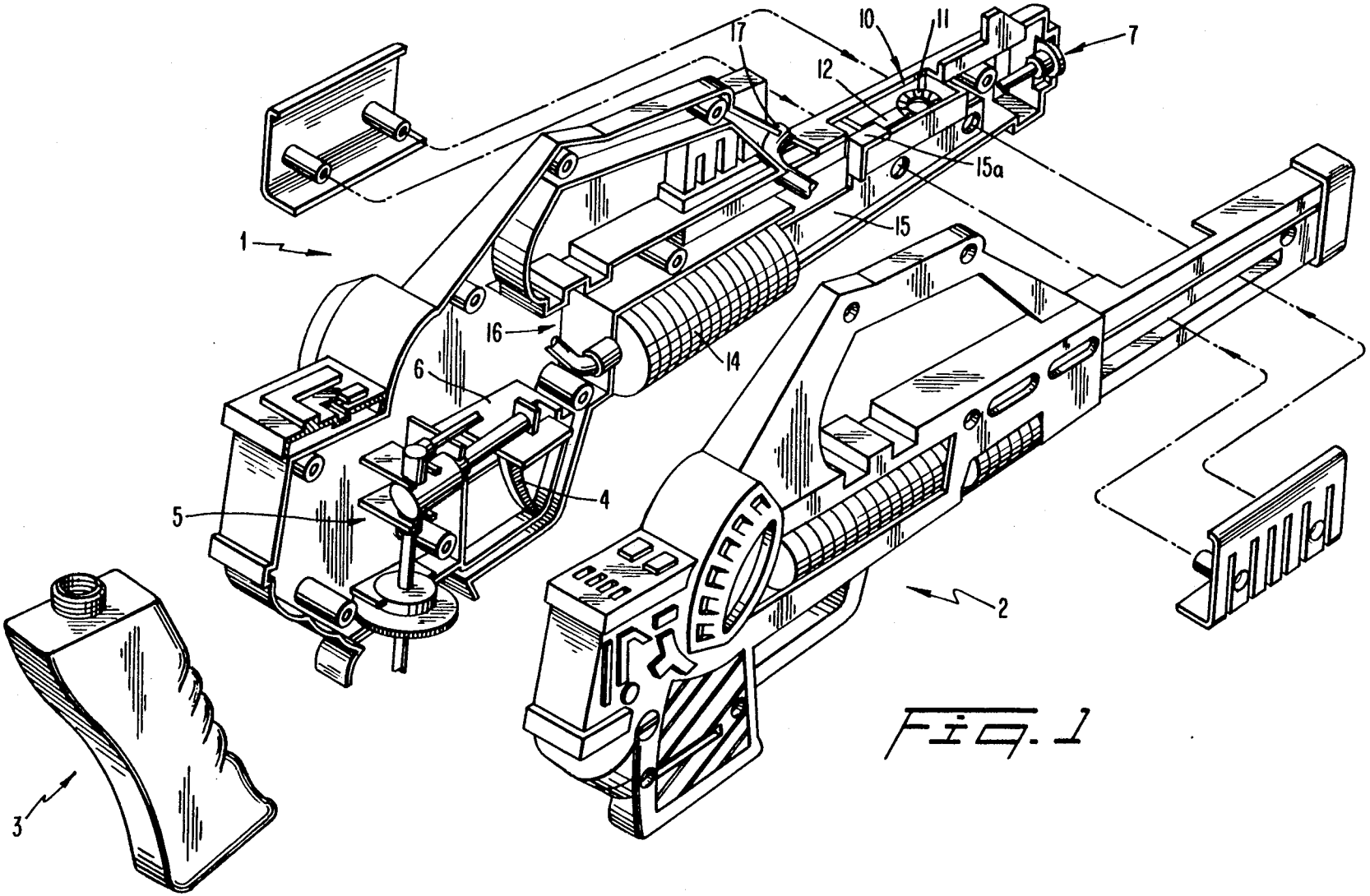
FIG. 1 is an exploded perspective view of the toy water gun.

Referring now to FIG. 1, the conventional toy water gun function will first be described. The gun has the outward appearance of a machine pistol, and comprises a left hand housing element 1 and a right hand housing element 2, a reservoir 3 for containing water and also serving as a gun stock, a trigger 4, a pump 5 and a discharge hose 6 extending from the pump 5 to the nozzle 7.

In use operation of the trigger 4 causes operation of the pump 5 which pumps water from the reservoir 3, along the discharge hose 6 and out through the nozzle 7. When the contents of the reservoir 3 have been discharged, the reservoir 3 may be detached, refilled, and put back in position.

Figure 2:
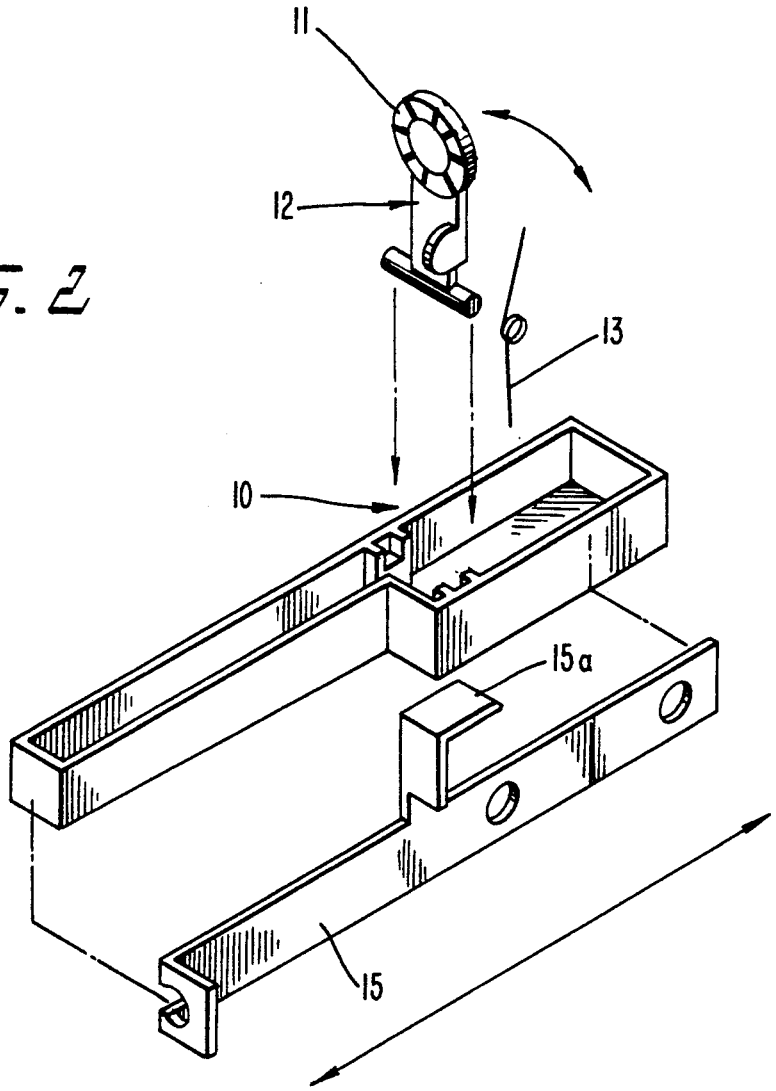
FIG. 2 is a similar view on a larger scale of a subassembly of the gun.

The novel feature of the toy machine pistol is the mechanism for allowing bubbles to be generated. This mechanism comprises a reservoir 10 for bubble forming liquid, a ring 11 at the end of an arm 12 which is pivotally moveable between a horizontal charging position in the reservoir 10 as shown in FIG. 1, and an upright firing position as shown in FIG. 2, a spring 13 for biassing the arm 12 to the upright position, a bellows 14 which in outward appearance resembles the cooling mechanism of a machine pistol, a mechanical linkage 15 connecting the outer end of the bellows 14 to the pivotal arm 12 and including an extension **15*a* which prevents the ring 11 pivoting to the upright position, and an air duct 16 leading from the near end of the bellows 14 to the ring 11** when in the upright position.

To prepare the toy machine pistol for use, the reservoir 10 is filled with a soapy liquid.

To use the bubble blowing function, the child simply grasps the outer end of the bellows 14 and compresses the bellows. The first result of compressing the bellows 14 is to pull the mechanical linkage 15 towards the user, retracting linkage extension **15*a* towards the child thereby allowing the arm 12 to pivot from the horizontal position to the upright position, so that the ring 11 is clear of the reservoir and is charged with a film of soapy liquid, and in appearance resembles a gunsight. The second result of compressing the bellows 14 is to deliver a stream of air along the air duct 16 and out through the air duct nozzle 17 towards the ring 11, thereby generating bubbles. Once the child releases the compressive pressure on the bellows 14, the bellows expands to its normal state, and the pivotal arm 12 pivots back to the horizontal position so that the ring 11** can take up a further charge of liquid.

The above described embodiment is given by way of illustrative example only and does not limit the scope of the invention which is defined by the claims.

I claim:

1. A toy water gun including a reservoir for containing water, a nozzle through which a jet of water may be fired, and a water pumping mechanism for pumping water from the water reservoir out through the nozzle, the toy water gun further including an additional reservoir for bubble forming liquid, a ring within which a film of bubble forming liquid may be formed, a ring mounting, the ring mounting being operable to move the ring from a first charging position within the additional reservoir so as to take up a charge of bubble forming liquid and a second firing position outside the reservoir in which bubbles may be blown from the ring, a bellows which may be manually compressed to direct a stream of air to the ring in the firing position thereof, and a linkage operatively connecting the bellows to the ring mounting so that as the bellows is compressed the ring is moved from the charging position to the firing position.

2. A toy water gun according to claim 1 in which the bellows is configured to have the appearance of the pump action of a gun and the ring mounting and the ring are arranged so that in the firing position they have the appearance of a gunsight.

* * * * *